United States Patent [19]

Schmitz-Josten et al.

[11] Patent Number: 4,728,254

[45] Date of Patent: Mar. 1, 1988

[54] METHOD AND APPARATUS FOR CONTROLLING A STEAM TURBINE OF A POWER STATION UNIT

[75] Inventors: Paul Schmitz-Josten, Heroldsberg; Rainer Nürnberger, Nürnberg, both of Fed. Rep. of Germany

[73] Assignee: M A N Gutehoffnungshütte GmbH, Nürnberg, Fed. Rep. of Germany

[21] Appl. No.: 893,597

[22] Filed: Aug. 6, 1986

[30] Foreign Application Priority Data

Aug. 7, 1985 [DE] Fed. Rep. of Germany ..... 3528292

[51] Int. Cl.[4] ..... F01D 17/04

[52] U.S. Cl. ..... 415/13; 60/652; 290/40 B

[58] Field of Search ..... 415/1, 17, 13, 51; 60/652; 290/40 R, 40 B, 40 C

[56] References Cited

U.S. PATENT DOCUMENTS

| | | | |
|---|---|---|---|
| 4,118,935 | 10/1978 | Andersson | 60/652 |
| 4,184,337 | 1/1980 | Bloch | 415/17 |
| 4,274,260 | 6/1981 | Bukajlo | 415/17 |
| 4,412,780 | 11/1983 | Collins et al. | 415/17 |
| 4,445,045 | 4/1984 | Ross | 290/40 B |
| 4,514,642 | 4/1985 | Ross | 290/40 R |

FOREIGN PATENT DOCUMENTS

| | | | |
|---|---|---|---|
| 60627 | 5/1980 | Japan | 415/13 |
| 145304 | 8/1984 | Japan | 415/13 |
| 800764 | 1/1981 | U.S.S.R. | 415/13 |
| 1110910 | 8/1984 | U.S.S.R. | 415/13 |

*Primary Examiner*—Robert E. Garrett
*Assistant Examiner*—John T. Kwon
*Attorney, Agent, or Firm*—Becker & Becker, Inc.

[57] ABSTRACT

The invention relates to a method (and an apparatus) for controlling a steam turbine of a power station unit that includes a steam turbine and a steam generator, with the output signal of the turbine controller acting on the adjusting mechanism of the turbine inlet valve arrangement. In order with such a method to relieve the turbine controller of those controller output variations that are already evident from the change of the reference inputs, the output signal of the turbine controller has added to it a signal that is computed from the load setpoint of the turbine controller according to the relationship governing the steam turbine $$\frac{\text{electrical output}}{\text{steam pressure}} = \text{inlet valve opening}$$

and that is supplied to the summating point in the computed magnitude or weighted by a factor k that deviates from unity.

3 Claims, 2 Drawing Figures

METHOD AND APPARATUS FOR CONTROLLING A STEAM TURBINE OF A POWER STATION UNIT

BACKGROUND OF THE INVENTION

1. Field of the Invention

The present invention relates to a method and an apparatus for controlling a steam turbine of a power station unit that includes a steam turbine and a steam generator, with the output signal of the turbine controller acting on the adjusting mechanism of the turbine inlet valve arrangement.

2. Description of the Prior Art

In conventional methods and apparatus of the aforementioned general type, the output signal is applied unbiased to the adjusting mechanism of the turbine inlet valve arrangement. In so doing, a relatively large amplitude or deviation of the control difference of the load controller is required in order to match the manipulated variable or controller output to the required load and the required pressure.

An object of the present invention is to provide a method and apparatus of the aforementioned general type according to which the turbine controller is not required to take care of such variations of the manipulated variable which are already evident from the variation of the reference variable.

DESCRIPTION OF PREFERRED EMBODIMENTS

According to the inventive method, this object is realized in that the output signal of the turbine controller has an additional signal added to it which is computed from the load setpoint of the turbine controller according to the relationship, $$\frac{\text{electric output}}{\text{steam pressure}} = \text{inlet valve opening},$$

that is applicable to the steam turbine, with this additional signal being supplied to the summating point in the magnitude calculated or weighted by a factor k, which deviates from unity.

If an inlet valve opening is computed from the load setpoint of the turbine to match the allied pressure setpoint, the turbine valves will, due to this control variable, already have their correct position, and the load controller will have to effect only minor corrections with its manipulated variable or controller output. Since the discrepancies between the load setpoint and the actual load will then be correspondingly smaller, it will be possible to better optimize the load controller, and a better dynamic response of load control will be obtained.

Pursuant to one exemplary embodiment of the inventive apparatus, a summating element is disposed in the signal line from the turbine controller to the adjusting mechanism of the turbine inlet valve arrangement, with one positive input of the summating element being connected to the output of the turbine controller, and with the other positive input of the summating element being connected to the output of a computing circuit in which the setpoint for "inlet valve opening" is computed.

Pursuant to another exemplary embodiment of the inventive apparatus, summating means is disposed in the signal line from the turbine controller to the adjusting mechanism of the turbine inlet valve arrangement, with one positive input of the summating means being connected to the output of the turbine controller, and with the other positive input of the summating means being connected to the output of a computing circuit in which the setpoint for "inlet valve opening" is computed, and with the negative input of the summating means being connected to a signal emitter for the basic value for "inlet valve opening."

BRIEF DESCRIPTION OF THE DRAWINGS

Exemplary embodiments of the invention are schematically shown in the drawing, in which.

DESCRIPTION OF PREFERRED EMBODIMENTS

Figure 2:
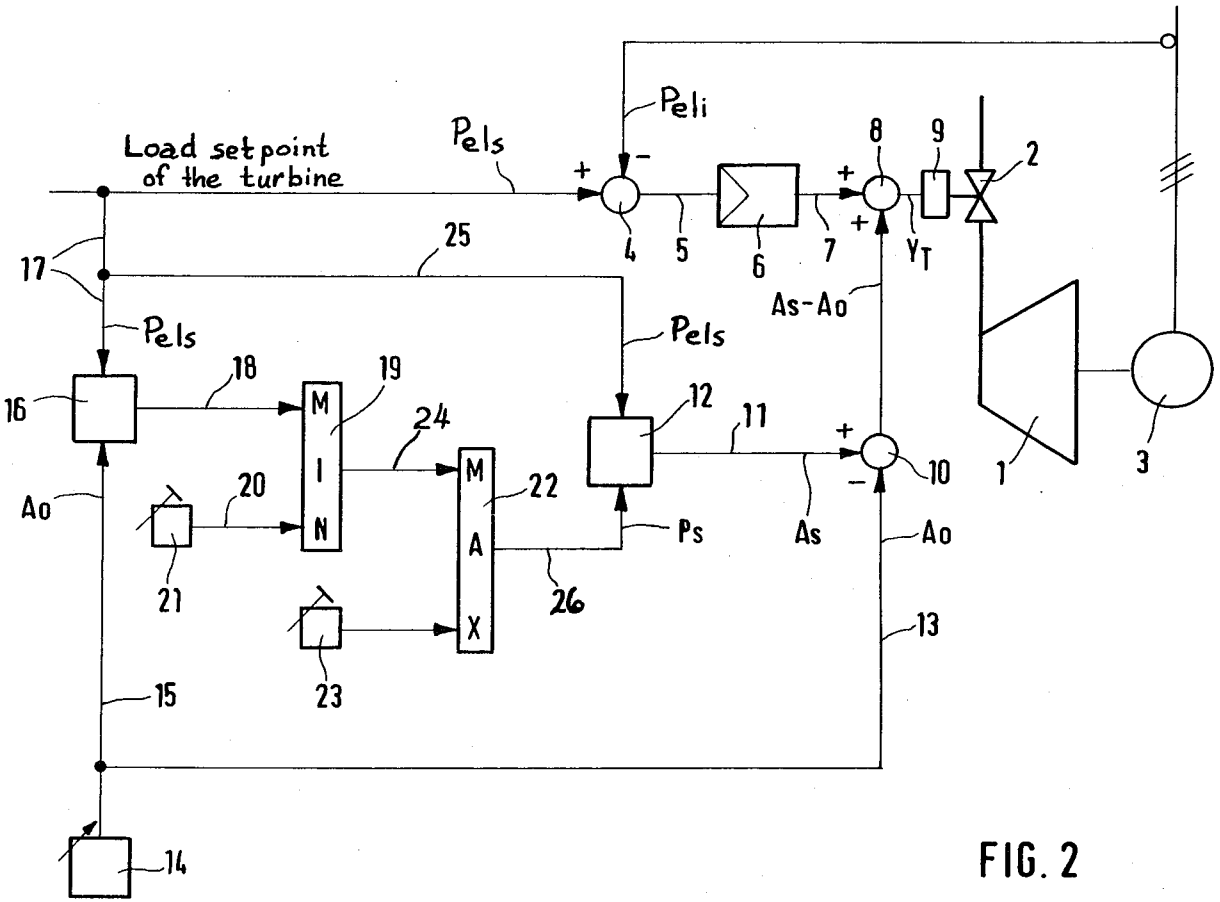
FIG. 2 shows a modified circuit diagram of the turbine control system of FIG. 1.

The power station unit essentially comprises the steam generator (not shown in detail), the steam turbine 1 with the turbine inlet valve or valves 2, and the generator 3 (FIG. 2).

The electrical power delivered by the generator 3 is compared in a setpoint/actual value comparator 4 with a load setpoint of the turbine $P_{elS}$. The load setpoint of the turbine $P_{elS}$ may be the output signal of a setpoint matching element-i.e. a controlled "following" integrator where the output of the integrator follows its input, and the rate of variation of the output value is predetermined by another input; the load setpoint $P_{elS}$ may also be obtained in another fashion. The difference between the load setpoint $P_{elS}$ and the actual load value $P_{eli}$ is supplied via the signal line 5 to the input of a turbine load controller 6 with the usual PI-action. The output of the load controller 6 is connected via the signal line 7 to one positive input of a summating element 8. The other positive input of the summating element 8 is connected with the output of a computing circuit in which an inlet valve opening setpoint $A_S$ is computed from the target unit output or load setpoint of the turbine ($P_{elS}$) according to the following equation, which is applicable for the steam turbine:

$$\text{electrical output/steam pressure} = \text{valve opening}.$$

This setpoint $A_S$ is applied in the computed amount, or—as shown in the illustrated samplereduced by a basic value of the valve opening $A_0$, to the summating element 8. The output signal of the summation element 8 actuates the adjusting mechanism 9 of the turbine inlet valve arrangement 2 in the conventional manner as a correcting signal $Y_T$.

The difference between the setpoint $A_S$ and the basic value $A_0$ is computed in a difference-deriving element 10, the positive input of which is connected via the signal line 11 with a dividing element 12, and the negative input of which is connected via the signal line 13 with a signal emitter 14 that supplies the basic value for the valve opening $A_0$-i.e. the value which corresponds to the inlet valve opening in the variable pressure mode of the power station unit. The basic value of the valve opening $A_0$ is furthermore supplied via the signal line 15 to a dividing element 16, the other input of which is supplied via the signal line 17 with the load setpoint of the turbine $P_{elS}$. The quotient $P_{elS}/A_0$ of the unit load setpoint and the basic value of the valve opening is computed in the dividing element 16, with this quotient corresponding in accordance with the equation referred to previously to the steam pressure setpoint $P_S$ of the steam generator. The steam pressure setpoint $P_S$ so calculated is supplied via the signal line 18 to one input of a minimum-value element 19, the output signal of which is equal to the lowest of all input signals. The other input of the minimum-value element 19 is connected via the signal line 20 to a signal emitter 21 that supplies, in the form of a signal, the highest steam pressure intended for normal operation. The output of the minimum-value element 19 is connected via a signal line as indicated in FIG. 2 to one input of a maximum-value element 22, the other input of which is connected to a signal transmitter 23 that supplies the minimum-steam pressure required in normal operation of the steam generator. In this manner, the steam pressure setpoint $P_S$ is limited via the elements 19 and 22 to remain within the limits required for normal operation.

The output of the maximum-value element 22 is connected via the signal line 24 to one input of the dividing element 12, the other input of which has the unit load setpoint $P_{elS}$ supplied to it via the signal line 25, with quotient $P_{elS}/P_S$ of the load setpoint and steam pressure setpoint being computed in the dividing element 12.

Figure 1:
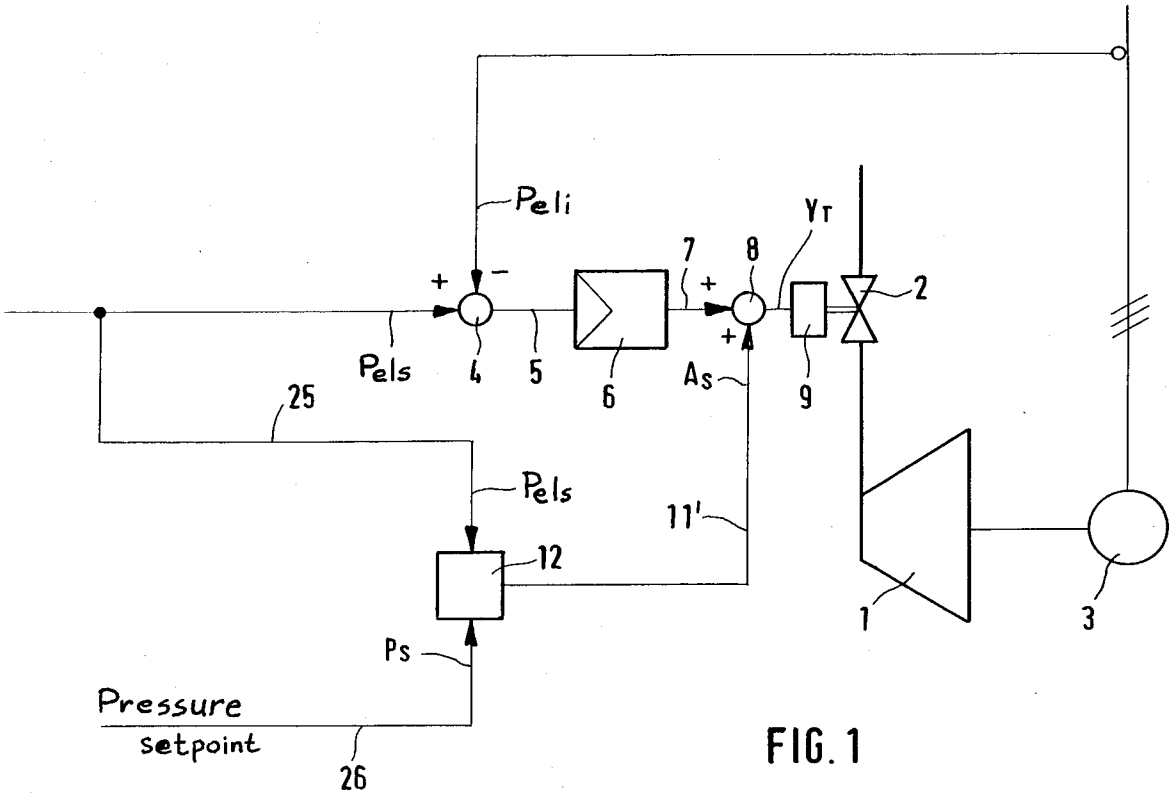
FIG. 1 shows that part of a circuit diagram of a turbine control system which is essential for the invention.

The control shown in FIG. 1 differs from the above described circuit arrangement in that the maximum-value element 22, the minimum-value element 19, plus the associated signal transmitters 21, 23 and the dividing element 16, are omitted. If the signal line 26 is connected to a setpoint emitter (not illustrated) and is set for a fixed value, the control system can be applied to turbines operating in the constant pressure mode.

The signal to be added to the output signal of the turbine controller 6 will preferably—at least approximately—correspond to the computed value $A_S$. A not inconsiderable relief of the turbine controller is also possible by means of signals which deviate considerably from the computed value $A_S$; the factor k referred to herewith may therefore have as a lower limit roughly the value 0.7, and as the upper limit roughly the value 1.3.

The present invention is, of course, in no way restricted to the specific disclosure of the specification and drawings, but also encompasses any modifications within the scope of the appended claims.

What we claim is:

1. A method of controlling a steam turbine of a power station unit that includes steam turbine and a steam generator, with the output signal of a turbine controller of a control system acting on an adjusting mechanism of a turbine inlet valve arrangement, said method according the steps of:

adding to said output signal of said turbine controller, at a summation point, a further signal as to valve opening rated value;

computing said further signal from the load setpoint of said turbine controller according to the following division relationship, which governs said steam turbine: electrical ouput/steam pressure=inlet valve opening; and supplying said further signal to said summation point at a value based on said computed magnitude and a magnitude derived by multiplying said computed magnitude by a factor which deviates from unity;

said computing being carried out for division of electrical output rated value and pressure rated value relatively into the electrical output rated value for controlling the valve arrangement not only initially but rather during entire output operation with which magnitude of valve adjusting value is decoupled from dynamics of the entire operation including actual output and with which advantageously via course of rated values via said computing there is anticipation of adjusting magnitude changes of said turbine controller that is relieved thereof and then must only compensate for disturbing influences of the control system.

2. An apparatus for controlling a steam turbine of a power station that includes a steam turbine having an electrical output including an output signal and a steam generator, with the output signal from the output of a turbine controller of a control system acting on an adjusting mechanism of a turbine inlet valve arrangement, said apparatus comprising:

a computing circuit that has an output, and in which is computed a setpoint for inlet valve opening;

a signal line that connects said output of said turbine controller of the control system to said adjusting mechanism of said inlet valve arrangement;

summating means disposed in said signal line, with said summating means having a first positive input that is connected to said output of said turbine controller of the control system, and a second positive input that is connected to said output of said computing circuit; and dividing means disposed in said signal line and included in said computing circuit in which an inlet valve opening signal is inversely proportional to rated value of steam pressure and directly proportional to the electrical output of the steam turbine to compute the inlet valve opening signal as well as an output thereof connected with said adjusting mechanism of said inlet valve arrangement.

3. An apparatus according to claim 2, which includes a difference-deriving means to subtract a basic value for inlet valve opening from valve adjustment rated value and corresponding to valve opening in constant pressure operation; and in which such difference is added at said summating means in place of valve adjustment rated value to the output of said turbine controller.

* * * * *